United States Patent [19]

Knepper et al.

[11] 4,029,589

[45] June 14, 1977

[54] PROCESS OF INHIBITING CORROSION AND/OR SWEETENING HYDROCARBONS

[75] Inventors: J. Irvine Knepper, Manchester; Richard L. Godar; James W. Propst, both of St. Louis, all of Mo.

[73] Assignee: Petrolite Corporation, St. Louis, Mo.

[22] Filed: Aug. 6, 1974

[21] Appl. No.: 495,233

[52] U.S. Cl. ..... 252/51; 252/54; 252/54.6; 252/392; 44/72; 44/73; 44/79

[51] Int. Cl.[2] ..... C10M 1/32; C10L 1/22

[58] Field of Search ..... 208/189; 44/79, 73, 44/72, 52; 252/392, 51, 54, 54.6; 21/2.5 R, 2.7 R

[56] References Cited

UNITED STATES PATENTS

| | | | |
|---|---|---|---|
| 1,635,216 | 7/1927 | Kettering et al. | 44/79 |
| 1,843,516 | 2/1932 | Oberle | 44/79 |
| 2,137,777 | 11/1938 | Lincoln et al. | 252/54 |
| 2,284,258 | 5/1942 | Brooks | 252/54 |
| 2,298,638 | 10/1942 | Prutton | 252/54 |
| 2,327,708 | 8/1943 | Herbst | 44/79 |
| 2,771,348 | 11/1956 | Meguerian | 44/79 |
| 3,228,880 | 1/1966 | Roberts et al. | 252/51 |
| 3,282,842 | 11/1966 | Bonner et al. | 252/54.6 |
| 3,806,457 | 4/1974 | Brown, Jr. | 252/54.6 |
| 3,816,322 | 6/1974 | Griffin et al. | 252/392 |

*Primary Examiner*—Daniel E. Wyman
*Assistant Examiner*—Mrs. Y. Harris-Smith
*Attorney, Agent, or Firm*—Sidney B. Ring; Hyman F. Glass

[57] ABSTRACT

A process of inhibiting corrosion and/or sweetening hydrocarbons so that they pass the Copper Strip Tarnish Test ASTM D-130 which comprises treating such hydrocarbons with iodine or bromine. These halogens are preferably employed with complexing compounds such as amines, carboxylic acids, alcohols, alkanolamines, ketones, etc.

24 Claims, No Drawings

PROCESS OF INHIBITING CORROSION AND/OR SWEETENING HYDROCARBONS

Most liquid hydrocarbon products such as aviation gasoline, aviation turbine fuel, automotive gasoline, farm tractor fuel, cleaner (Stoddard) solvents, kerosene, diesel fuel, distillate fuel oil, lubricating oil, and other petroleum products, must meet certain corrosion standards. One of the most widely used tests to determine the corrosiveness of a product is the test for its corrosivity to copper by employing the Standard Method For Detection of Copper Corrosion from Petroleum Products by The Copper Strip Tarnish Test. (ASTM D-130)

This test is so sensitive that the following fuels or solvents will not pass this test:

1. Fuels or solvents produced by normal refining processing will occasionally not pass the test;
2. Fuels or solvents contaminated with sulfur compounds such as $H_2S$ and mercaptans;
3. Fuels or solvents contaminated with crude oil and/or condensate.

As a rule, such fuels or solvents which do not pass the copper strip test must be blended off, reprocessed, or treated. One of the treating processes employed to make them meet ASTM D-130 standards is a sweetening process, for example such special processes known as "Bender" or "Merox" sweetening processes, etc.

We have now discovered a process of inhibiting and/or sweetening hydrocarbons so that hydrocarbons such as fuels which do not pass copper strip test, ASTM D-130, when treated with iodine ($I_2$) or bromine ($Br_2$) yield a product which passes the copper strip test.

The significance of our invention is that it can be used to replace or supplement other treating processes used to make hydrocarbons pass the copper strip test. It allows crude and/or unrefined and/or semi-refined products to be transported or handled in the same system as finished products. Our additives can be added to the finished products to protect them from quality degradation as per ASTM D-130, provided the proper operational procedures are employed to minimize contamination of such finished products with unfinished products.

As the energy crisis has developed shortages of both crude and refined fuels have appeared. Some of existing transportation systems have been found to be unsatisfactory in expediently relieving these shortages. One proposal is to use the same pipeline to transport both crude and refined oil. However, one problem involved in such practice of using the same pipeline for both crude and refined oil, is the problem of contamination of the refined oil with crude. For example, if small amounts of crude contaminate the refined oil, the refined oil might be off-spec so that it does not pass copper strip test ASTM D-130. The use of one pipeline for both crude and refined oil versus the building of a second pipeline has great economic advantages.

We have now discovered that when a pipeline is used for both crude and refined oil, and the refined oil is "off-spec" as to ASTM D-130 due to crude contamination, the "off-spec" refined oil can be brought up to specification by treating it with iodine ($I_2$) or bromine ($Br_2$).

Many types of chemical additives are added to petroleum hydrocarbons to improve the properties thereof. As a general rule, the role of each additive is specific to each problem. Thus, for example, a chemical which improves the stability of a fuel oil might not necessarily improve the stability of a gasoline; or a chemical which acts as a corrosion inhibitor in a hydrocarbon system may not necessarily improve the stability of the hydrocarbon. This indicates the chemical additives act by different mechanisms in different systems and/or act by different mechanisms even in the same system to solve different problems. For example, (1) although amine-iodine complexes improve copper-strip corrosion inhibition in both fuel oils and gasolines, they improve fuel oil stability, but not gasoline stability; (2) amine-bromine complexes not only improve copper-strip inhibition in fuel oil but also improve fuel oil stability; (3) although iodine alone improves copper-strip inhibition in fuel oil and gasoline, it does not improve fuel oil or gasoline stability.

In summary, amine-iodine complexes work by a different mechanism in combatting copper corrosion than in fuel stabilization; thus they reduce corrosion in fuel oil and gasolines and improve stability of fuel oil and not gasoline. Iodine, on the other hand, although it reduces the corrosivity of fuel, does not improve fuel stability.

Although iodine and bromine can be employed per se, they are preferably employed as complexes, for example as complexes of amines, carboxylic acids, alcohols, alkanolamines, ketones, etc.

Although most amines, alkanolamines, alcohols, ketones, etc., alone do not inhibit the corrosivity of fuels to copper, these compositions in combination with iodine and bromine do render hydrocarbons less corrosive to copper as measured by ASTM D-130. Unexpectedly we have found that metal deactivators, such as N, N-disalicylidene-1,2-propane diamine, alone do not render hydrocarbons less corrosive as per the copper strip test.

Thus a metal deactivator, for example those conveniently employed in deactivating copper, iron and other metals in hydrocarbon systems, does not modify a fuel's corrosivity to copper as measured by ASTM D-130.

The following examples are presented for purposes of illustration and not of limitation.

The additives employed herein are presented in the following table.

TABLE I

Additive Compositions

| Additive Identification | Composition |
|---|---|
| Composition A | 10% Iodine, 18% t-dodecylamine, 72% aromatic solvent |
| Composition B | 1.77% Iodine, 3.19% t-dodecylamine<br>60.01% ethoxylated amine,t-octylamine + EtO (1:1M)<br>10.00% acrylic copolymer in solvent<br>25.03% aromatic solvent |
| Composition C | 1.29% Iodine, 2.29% t-dodecylamine<br>42.86% ethoxylated amine,t-octylamine + EtO (1:1M)<br>7.14% acrylic copolymer in solvent |

TABLE I-continued

| Additive Identification | Additive Compositions Composition |
|---|---|
| | 12.86% a poly-ester-amide-acid derived from reacting dodecenyl succinic anhydride with ethylene glycol and isopropanolamine |
| | 33.56% aromatic solvent |
| Composition D | 2.70% Iodine, 4.86% t-dodecylamine |
| | 12.45% ethoxylated amine,t-octylamini + EtO (1:1M) |
| | 3.00% acrylic copolymer in solvent |
| | 6.75% a poly-ester-amide-acid derived from reacting dodecenyl succinic anhydride with ethylene glycol and isopropanolamine |
| | 70.24% aromatic solvent |
| Composition E | 3.00% Iodine, 13.4% t-dodecylamine |
| | 4.00% acrylic copolymer in solvent |
| | 6.75% a poly-ester-amide-acid derived from reacting dodecenyl succinic anhydride with ethylene glycol and isopropanolamine |
| | 72.85% aromatic solvent |
| Composition F | 6.7% Bromine, 18.3% t-dodecylamine, 75% aromatic solvent |
| Composition G | 83% ethoxylated amine,t-octylamine + EtO (1:1M) |
| Composition H | 1.53% Iodine, 2.72% t-dodecylamine |
| | 51.02% ethoxylated amine,t-octylamine + EtO (1:1M) |
| | 8.50% acrylic copolymer in solvent |
| | 7.49% a poly-ester-amide-acid derived from reacting dodecenyl succinic anhydride with ethylene glycol and isopropanolamine |
| | 28.74% aromatic solvent |
| Additive I | 60% N,N' disalicylidene-1,2-propane diamine |
| | 40% aromatic solvent |
| | (Copper metal deactivator) |
| Composition J | 10% Iodine, 18% dodecyl alcohol, 72% aromatic solvent |
| Composition K | 10% Iodine, 17% decanoic acid, 73% aromatic solvent |
| Composition L | 10% Iodine, 26% Tetrapropenyl succinic anhydride, 64% aromatic solvent |
| Composition M | 10% Iodine, 14% 2,6-Dimethyl-4-heptanone, 76% aromatic solvent |
| Composition N | 2.5% Iodine, 20.75% ethoxylated amine i.e., dodecyl-amine + EtO (1:1M), 76.75% aromatic solvent |

Iodine and bromine employed herein are elemental iodine ($I_2$) and elemental bromine ($Br_2$).

EXAMPLE I

Procedure: ASTM D-130, 3 hrs. at 100° F.
Fuel: No. 2 Fuel Oil (no additives) contaminated with 6 ppm $H_2S$

| Additive | Conc. (ppm) | Copper Strip Rating |
|---|---|---|
| None | — | 2c |
| Composition A | 200 | 1b |
| t-dodecylamine | 200 | 2c |

EXAMPLE II

Pipe Line Fuel
Procedure: ASTM D-130, 3 hrs. at 122° F.
Fuel:

Fuel sample obtained from pipeline, 2400 bbl sour crude shipped through 12 inch finished product pipeline.

Sample taken at end of the pipeline 50 miles from origin.

Sample of fuel oil taken 1000 bbl after crude in a portion of the tender containing no additive.

Sample contaminated with additional $H_2S$ at levels noted.

| $H_2S$ Contaminant in ppm | Additive | Conc. (ppm) | Copper Strip Rating |
|---|---|---|---|
| None | None | — | 1a |
| 1 | None | — | 1b |
| 1 | Composition B | 175 | 1a |
| 2 | None | — | 2c |
| 2 | Composition B | 175 | 1b |

-continued

| $H_2S$ Contaminant in ppm | Additive | Conc. (ppm) | Copper Strip Rating |
|---|---|---|---|
| 5 | None | — | 2e |
| 5 | Composition C | 200 | 1b |
| 5 | Composition D | 200 | 1b |

EXAMPLE III

Procedure: ASTM D-130, 3 hrs. at 212° F.
Fuel: No. 2 without additive — contaminated within 2.5 ppm $H_2S$

| Additive | Add Conc ppm | Copper Strip Rating |
|---|---|---|
| None | — | 2c |
| Composition E | 300 | 1a |
| Composition E | 600 | 1a |
| Composition C | 300 | 1a |
| Composition C | 600 | 1a |

EXAMPLE IV

Procedure: ASTM D-130, 3 hrs. at 212° F.
Fuel: Obtained from Pipeline

Sample of fuel oil taken 1000 bbl behind a 2400 bbl batch of sour crude oil shipped through a 12 inch finished produce pipeline Sample taken 50 miles from pt. of origin in a portion of the fuel oil tender containing no additive

| Test | Additive | Add conc ppm | Copper Strip Rating |
|---|---|---|---|
| 1 | None | — | 4a |
| 1 | Composition E | 200 | 1b |
| 1 | Composition C | 200 | 1a |
| 1 | Composition C | 400 | 1b |
| 2 | None | — | 3b |
| 2 | Composition E | 50 | 1a |
| 2 | Composition E | 100 | 1a |
| 2 | Composition E | 150 | 1a |
| 2 | Composition C | 50 | 1b |
| 2 | Composition C | 100 | 1a |
| 2 | Composition C | 150 | 1a |

EXAMPLE V

Procedure: ASTM D-130, 3 hrs. at 212° F.

Fuel:

Sample of fuel taken 1000 bbl behind a 2400 bbl batch of sour crude oil shipped through a finished product pipeline.

Sample taken from portion of fuel oil tender containing no additive at a point 50 miles from point of origin.

| Additive | Add Conc. (ppm) | Copper Strip Rating |
|---|---|---|
| None | — | 4a |
| Composition D | 25 | 2d |
| Composition D | 50 | 2a |
| Composition D | 75 | 1b |

EXAMPLE VI

Procedure: ASTM D-130, 3 hrs. at 212° F.

Fuel: No. 2 Fuel Oil (no additives) contaminated with 3 ppm $H_2S$.

| Additive | Add Conc. (ppm) | Copper Strip Rating |
|---|---|---|
| None | — | 2d |
| Iodine | 3 | 2d |
| Iodine | 6 | 2a |
| Iodine | 9 | 1b |
| Iodine | 12 | 1b |
| Iodine | 15 | 1b |

EXAMPLE VII

Fuel: Sour gasoline (see characterization below)

| Property/Test | Sour Gasoline with Composition H added at the ppm indicated | | | |
|---|---|---|---|---|
| | 0 ppm | 50 ppm | 100 ppm | 200 ppm |
| Corrosion (ASTM D-130, 3 hrs. at 122° F. | 2c | 1b | 1b | 1a |
| Doctor Test | pos. | — | — | neg. |
| $H_2S$ (by Lead acetate) | pos. | — | — | neg. |
| Mercaptan (wt%) | 0.0012 | — | — | 0.0006 |
| Sulfur (wt%) | 0.06 | — | — | 0.06 |
| API Gravity | 66.5 | — | — | 66.8 |
| ASTM Distillation | | | | |
| IBP, ° F. | 80 | — | — | 82 |
| 10% Evap., ° F. | 103 | — | — | 109 |
| 50% Evap., ° F. | 188 | — | — | 196 |
| E.P., ° F. | 394 | — | — | 395 |
| Residue, % | 1.0 | — | — | 1.0 |
| Loss, % | 4.0 | — | — | 4.5 |
| Research Octane | 94.7 | — | — | 94.8 |
| Motor Octane | 85.6 | — | — | 85.5 |

EXAMPLE VIII

Procedure: ASTM D-130, 3 hrs. at 212° F.

Fuel: No. 2 Fuel Oil (no additives) contaminated with 3 ppm $H_2S$

| Additive(s) | Concentration(s), ppm | Copper Strip Rating |
|---|---|---|
| None | — | 2c |
| Composition A | 120 | 2a |
| Composition A + Composition G | 120 +480 | 1b |
| Composition F | 120 | 2a |

EXAMPLE IX

Procedure: ASTM D-130, 3 hrs. at 122° F.

Fuel: No. 2 Fuel Oil (no additives) contaminated with 5 ppm $H_2S$

| Additive | Conc (ppm) | Copper Strip Rating |
|---|---|---|
| None | — | 3b |
| Additive I | 200 | 3b |
| Additive I | 400 | 3b |
| Additive I | 600 | 3b |

EXAMPLE X

Procedure: ASTM D-130, 3 hrs. at 212° F.

Fuels:

Fuel A - No. 2-D Diesel Fuel

Fuel B - No. 2 Furnace Oil

| Fuel | Concentration of 1,8-octanedithiol in ppm | Concentration of Composition H in ppm | Copper Strip Rating |
|---|---|---|---|
| A | 0 | 0 | 1a |
| A | 50 | 0 | 2e |
| A | 50 | 100 | 2a |
| A | 50 | 300 | 1b |
| B | 0 | 0 | 1a |
| B | 50 | 0 | 3a |
| B | 50 | 100 | 1b |
| B | 50 | 300 | 1a |

EXAMPLE XI

Procedure: ASTM D-130, 3 hrs. at 212° F.

Fuel: No. 2 Furnace Oil

| Concentration of 1,8-octanedithiol | Additive | Conc. (ppm) | Copper Strip Rating |
|---|---|---|---|
| 125 | none | — | 2a |
| 125 | Composition A | 100 | 1b |
| 125 | Composition J | 100 | 1b |
| 125 | Composition K | 100 | 1b |
| 125 | Composition L | 100 | 1b |
| 125 | Composition M | 100 | 1b |
| 70 | none | — | 2a |
| 70 | Composition A | 10 | 1b |
| 70 | Composition A | 20 | 1b |
| 70 | Composition A | 40 | 1a |
| 70 | Composition J | 10 | 2a |
| 70 | Composition J | 20 | 1b |
| 70 | Composition J | 40 | 1a |
| 70 | Composition K | 10 | 2a |
| 70 | Composition K | 20 | 1a |
| 70 | Composition K | 40 | 1a |

-continued

| Concentration of 1,8-octanedithiol | Additive | Conc. (ppm) | Copper Strip Rating |
|---|---|---|---|
| 70 | Composition L | 10 | 2a |
| 70 | Composition L | 20 | 1b |
| 70 | Composition L | 40 | 1a |
| 70 | Composition M | 10 | 1b |
| 70 | Composition M | 20 | 1b |
| 70 | Composition M | 40 | 1a |

EXAMPLE XII

Procedure: ASTM D-130, 3 hrs. at 212° F.
Fuel: No. 2 Fuel Oil contaminated with approximately 3 ppm $H_2S$.

| Additive | Additive Concentration (ppm) | Copper Strip Rating |
|---|---|---|
| none | — | 2d |
| Composition A | 300 | 2a |
| Composition J | 300 | 2c |
| Composition K | 300 | 1b |
| Composition L | 300 | 1b |
| Composition M | 300 | 2b |

EXAMPLE XIII

Procedure: ASTM D-130, 3 hrs. at 122° F.
Hydrocarbon:
Light Straight Run Gasoline Charge to Merox Treater after caustic wash boiling range 80° to 285° F.

| Additive | Additive Concentration (ppm) | Copper Strip Rating |
|---|---|---|
| none | — | 2a |
| Composition B | 140 | 1b |
| Composition N | 100 | 1a |

A sufficient amount of iodine or bromine to allow the hydrocarbon to pass the Copper Strip Tarnish Test ASTM D-130 is employed. In general, at least about 0.01 ppm of iodine or bromine, such as from about 0.05 to 10,000 ppm, for example from about 1.5 to 50 ppm, but preferably from about 3 to 30 ppm is employed.

Iodine and bromine are preferably employed as complexes, for example, as complexes of amines, carboxylic acids, alcohols, alkanolamines, ketones, etc.

As is quite evident, other iodine or bromine-containing formulations will be developed which could be useful in this invention. It is, therefore, not only impossible to attempt a comprehensive catalogue of such compositions, but to attempt to describe the invention in its broader aspects in terms of specific chemical names of its components used would be too voluminous and unnecessary since one skilled in the art could by following the description of the invention herein select useful agents. This invention lies in the use of suitable iodine and bromine systems as corrosion inhibitors and/or "sweetening additives" and the individual compositions are important only in the sense that their properties can affect its function. To precisely define each specific formulation in light of the present disclosure would merely call for chemical knowledge within the skill of the art in a manner analagous to a mechanical engineer who prescribes in the construction of a machine the proper materials and the proper dimensions thereof. From the description in this specification and with the knowledge of a chemist, one will know or deduce with confidence the applicability of specific compositions suitable for this invention by applying them in the process set forth herein. In analogy to the case of a machine, wherein the use of certain materials of construction or dimensions of parts would lead to no practical useful result, various materials will be rejected as inapplicable where others would be operative. One can obviously assume that no one will wish to employ a useless iodine or bromine-containing system nor will be misled because it is possible to misapply the teachings of the present disclosure to do so. Thus, any iodine or bromine-containing system that can perform the function stated herein can be employed.

We claim:

1. A process of inhibiting the corrosion of a metal by a liquid hydrocarbon product coming in contact therewith, said liquid hydrocarbon product, prior to the herein recited treatment being incapable of passing the Copper Strip Tarnish Test ASTM D-130, which comprises treating said liquid hydrocarbon product by adding thereto an additive selected from the group consisting of iodine, bromine, complexes of iodine and complexes of bromine, said additive being employed in an amount sufficient to enable said liquid hydrocarbon product to pass said Copper Strip Tarnish Test.

2. The process of claim 1 wherein said additive is elemental iodine.

3. The process of claim 1 wherein said additive is elemental bromine.

4. The process of claim 1 wherein said additive is a complex of iodine.

5. The process of claim 1 wherein said additive is a complex of bromine.

6. The process of claim 1 wherein said additive is a complex of iodine or bromine with a member of the group consisting of amines, carboxylic acids, alcohols and ketones.

7. The process of claim 6 wherein said additive is an amine-iodine complex.

8. The process of claim 7 wherein said amine is t-dodecylamine.

9. The process of claim 7 wherein said amine is ethoxylated t-dodecylamine.

10. The process of claim 8 wherein ethoxylated t-octylamine is also added.

11. The process of claim 6 wherein said additive is an amine-bromine complex.

12. The process of claim 6 wherein said additive is a carboxylic acid-iodine complex.

13. The process of claim 12 wherein said carboxylic acid is decanoic acid.

14. The process of claim 6 wherein said additive is an alcohol-iodine complex.

15. The process of claim 14 wherein said alcohol is dodecyl alcohol.

16. The process of claim 6 wherein said additive is a ketone-iodine complex.

17. The process of claim 16 wherein said ketone is 2,6-dimethyl-4-heptanone.

18. The process of claim 4 wherein said additive is a complex of iodine and tetrapropenyl succinic anhydride.

19. The process of claim 1 wherein an aromatic solvent is employed with said additive.

20. The process of claim 1 wherein said hydrocarbon product is a refined oil which has been contaminated with crude oil.

21. The process of claim 1, wherein said liquid hydrocarbon product is a member of the group consisting of fuels, solvents and lubricants.

22. The process of claim 21, wherein said liquid hydrocarbon product is a fuel.

23. The process of claim 21, wherein said liquid hydrocarbon product is a solvent.

24. The process of claim 21, wherein said liquid hydrocarbon product is a lubricant.

* * * * *